United States Patent [19]

Preato

[11] Patent Number: 4,712,798

[45] Date of Patent: Dec. 15, 1987

[54] GOLF PUTTER

[76] Inventor: Mario Preato, 7514 E. Granada Rd., Scottsdale, Ariz. 85257

[21] Appl. No.: 835,983

[22] Filed: Mar. 4, 1986

[51] Int. Cl.[4] ..... A63B 53/16; A63B 53/06

[52] U.S. Cl. ..... 273/164; 273/171; 273/81.2; 273/167 A; 273/77 R

[58] Field of Search ..... 273/81.2, 194 A, 168, 273/171, DIG. 1, 164, 167 A, 169, 170, 172

[56] References Cited

U.S. PATENT DOCUMENTS

| | | | |
|---|---|---|---|
| 1,586,469 | 5/1926 | Revell | 273/81.2 |
| 3,403,912 | 10/1968 | Maroun | 273/194 A |
| 3,486,755 | 12/1969 | Hodge | 273/168 X |
| 3,638,942 | 2/1972 | Bassett | 273/DIG. 1 |
| 4,369,974 | 1/1983 | Komperda | 273/168 X |
| 4,423,874 | 1/1984 | Stuff | 273/171 |
| 4,591,160 | 5/1986 | Piragino | 273/DIG. 1 |

FOREIGN PATENT DOCUMENTS

| | | | |
|---|---|---|---|
| 1432688 | 4/1976 | United Kingdom | 273/168 |

*Primary Examiner*—George J. Marlo
*Attorney, Agent, or Firm*—Harry M. Weiss & Associates

[57] ABSTRACT

According to the present invention there is provided a novel golf club for use in putting. The novel golf club comprises, in the preferred embodiment thereof, a generally triangular shaped head made of a suitably resilient laminated polycarbonate plastic, and including a sighting prism on the upper surface thereof. The club also includes a shaft including two detachable portions. The head may contain metal bands or a weight receiving cavity for weighting purposes.

10 Claims, 6 Drawing Figures fig. 1
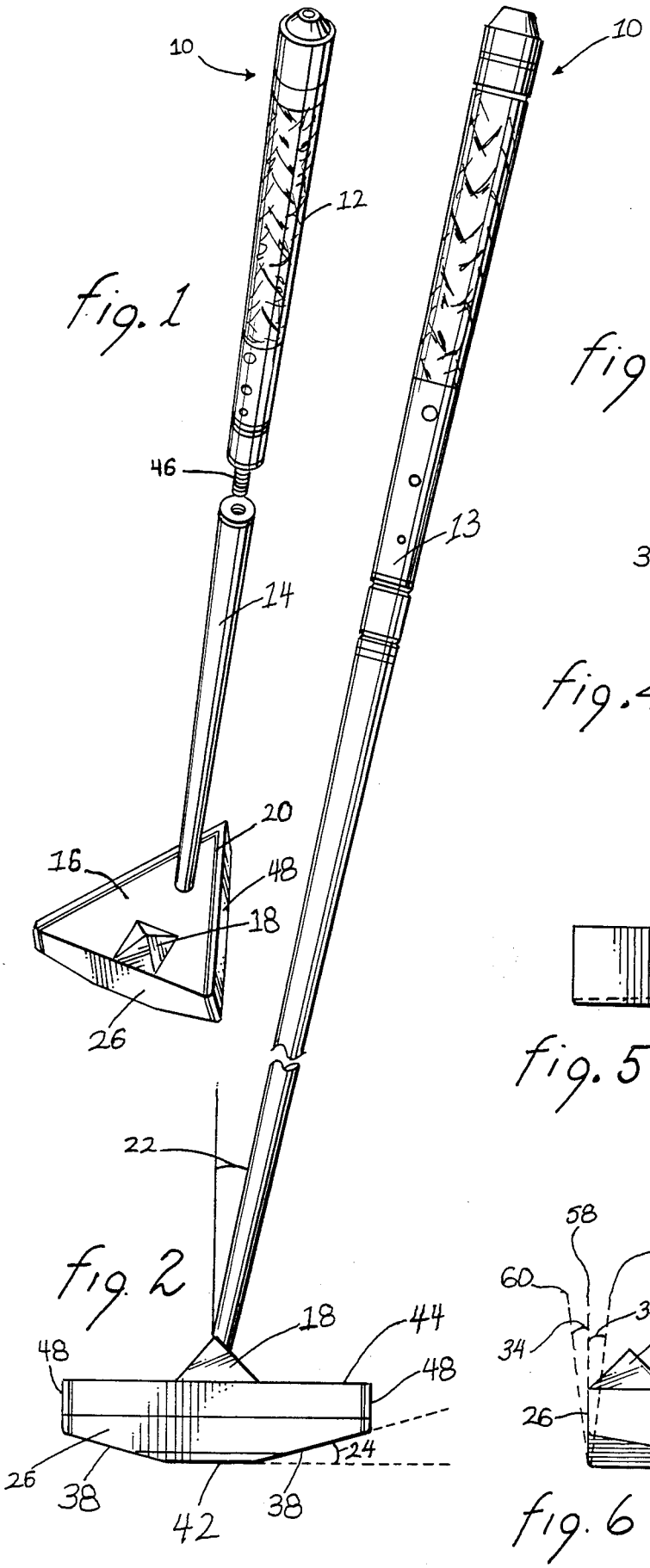
fig. 2
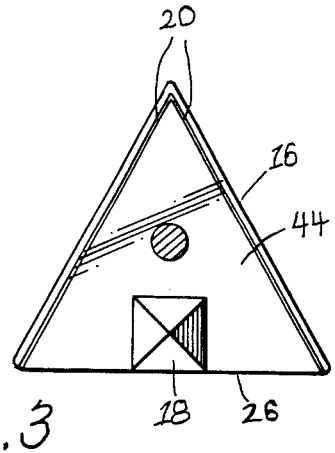
fig. 3
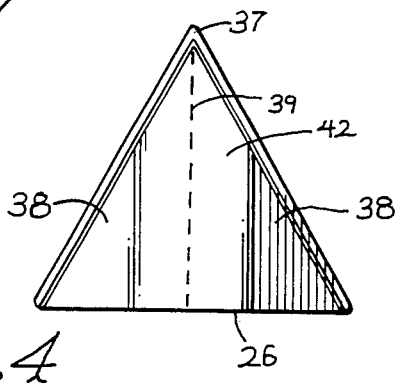
fig. 4
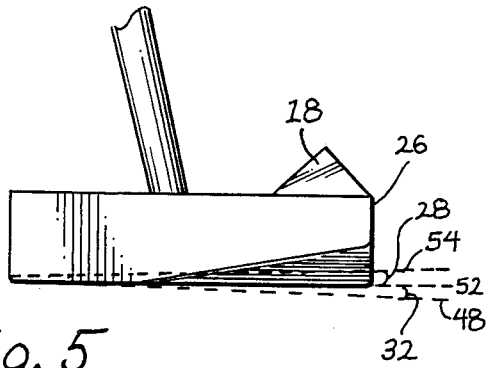
fig. 5
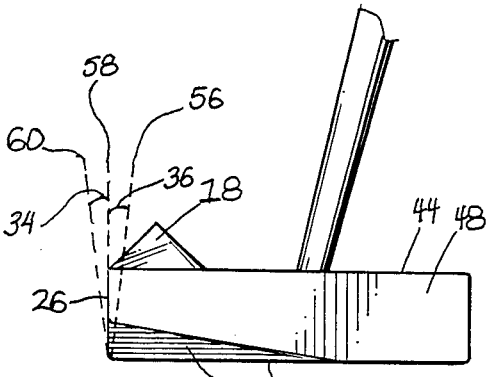
fig. 6

GOLF PUTTER

BACKGROUND OF THE INVENTION

The present invention relates generally to clubs for use in playing the game of golf. More particularly, the present invention provides a new type of golf club which may be used as a putter. The putter of the present invention substantially improves the accuracy of a golfer's putt shot. Among both avid and occasional golfers, there is perhaps no more challenging a part of the game as the putt shot. The golfer's ability to negotiate a golf green with an accurate putt substantially impacts on his score. Conventional golf putters utilize a generally rectangular metal head to strike a golf ball when putting. These conventional putters are prone to being dented thereby creating an uneven striking surface which causes erratic rolling of the golf ball. Additional problems present with conventional golf putters include a lack of adjustability of the length of the shaft portion, the lack of adjustability of the weight of the club, the non-resiliency of the striking surface of the club head and the singular manner in which the club can be used.

Accordingly, a need exists for a golf putter which affords adjustability of both length and weight, which has a highly resilient striking surface and which can be used from different putting positions.

SUMMARY OF THE INVENTION

It is an object of the present invention to provide a golf putter which substantially improves the accuracy of a putt shot.

It is another object of the present invention to provide a golf putter which provides a striking surface with superior resiliency characteristics.

It is yet another object of the present invention to provide a golf putter which may be used effectively from different putting positions.

It is still another object of the present invention to provide a golf putter which may be manufactured to be adjusted as to both length and weight or non-adjustable.

It is a further object of the present invention to provide a golf putter which is not prone to having the striking surface being dented thereby causing erratic golf shots.

It is a still further object of the present invention to provide a golf putter with a sight for centering the golf shot on the center of the striking surface of the putter.

It is yet a further object of the present invention to provide a golf putter which may be used in full compliance with the Professional Golf Association rules and regulations.

The foregoing and other objects, features and advantages will be apparent from the following, more particular description of the preferred embodiments of the invention as illustrated in the accompanying drawings.

BRIEF DESCRIPTION OF THE DRAWINGS

FIG. 1 is a partially exploded perspective view of an adjustable golf putter according to one embodiment of the present invention there is shown an adjustable shaft having at least two sections removably attached.

FIG. 2 is a side elevational view of a golf putter according to the present invention showing the striking surface of the head of the putter, the laminated structure of the head and the pyramid shaped centering sight.

FIG. 3 is a top elevational view of the head of a golf putter according to the present invention showing the pyramid shaped centering sight, the generally triangular shape of the head of the golf putter and metal weight bands laminated onto the generally triangular shaped head of the golf putter.

FIG. 4 is a bottom elevational view of the head of a golf putter according to the present invention showing the angular slants and flat portion of the bottom surfce of the head of the golf putter.

FIG. 5 is a side elevational view of the head of a golf putter according to the present invention showing one embodiment of the angulation of the striking surface of the golf putter.

FIG. 6 is a side elevational view of the head of a golf putter according to the present invention showing an alternate embodiment of the angulation of the striking surface of the golf putter.

DESCRIPTION OF THE PREFERRED EMBODIMENT

FIG. 1 illustrates a golf putter 10 according to the present invention. The golf putter 10 comprises a generally triangular shaped head 16, preferably constructed of a laminated polycarbonate plastic manufactured by General Electric under the trademark "Lexan" which provides superior resiliency properties when striking a golf ball. The generally triangular shaped head 16 has a striking surface 26 for striking a golf ball. Pyramid shaped centering sight 18 is firmly affixed to a top surface 44 of the generally triangular shaped head 16 of the golf putter 10. The pyramid shaped centering sight 18 is preferably firmly affixed to the top surface 44 of the generally triangular shaped head 16 such that it lies adjacent to the striking surface 26, and at a midpoint in the length of the striking surface 26. The pyramid shaped centering sight gathers ambient light and, through refraction within the pyrimadial structure, causes the apex of the pyramid to be highlighted when viewed by a golfer from a position above the pyramid. This effect permits a golfer to precisely and easily see the optimum position for striking a golf ball on the striking face 26 and aim accordingly.

Metal bands 20 may be made of any metal, preferably out of brass, or powdered lead may be inserted in a cavity in the head 16 having a screw-type cap 21 which serve as weights which may be adjusted during the manufacturing of the golf putter 10 according to the desires of the golfer. The golf putter 10 has a shaft 13, preferably constructed of wood, graphite, graphite composite, aluminium, steel or any other suitable material, which may consist of at least two removably attached pieces 12, 14, which permit adjustments to be made in the length of the shaft 13. Any suitable attachment may be used for removably joining the pieces of the shaft 13, preferably a screw-type attachment 46, so long as the entire shaft 13 is stable when the pieces 12, 14 are joined.

FIG. 2 illustrates the configuration of the head 16 of golf putter 10, in particular, the laminated structure of the head comprising preferably three or four layers of "Lexan" 26, but the head 16 may be constructed of a unitary piece of "Lexan." The head 10 has a flat top surface 44, a flat bottom surface 42 generally parallel to the flat top surface 44, side surfaces 48 and angularly sloped surfaces 38. Angle 24 formed by the plane of angularly sloped surface 38 and the plane of flat bottom surface 42 may be of any suitable angle. Angle 22 formed by the plane of flat top surface 44 and shaft 13 may be any angle suitable for the particular golfer. Professional Golf Association rules require that the sum of angle 22 and and angle 24 must be greater than 10 degrees.

FIG. 4 illustrates flat bottom surface 42 and angularly sloped surfaces 38. It is critical to note that golfing rules and regulations require that the length of striking surface 26 be relatively greater than the distance represented by a line 39 bisecting the angle created by the apex 37 which is perpendicular to striking surface 26.

FIG. 3 illustrates the generally triangular shaped head 16 of the golf putter 10, also showing the pyramid shaped centering sight 18 and adjustable weight bands 20.

FIG. 5 and FIG. 6 disclose alternate embodiments for the angulation of striking surface 26. In FIG. 5 there is shown alternate positions of the head 16 shown by angles 28 and 32 defined by the angle formed between the horizontal plane of the top surface of the head 16 and the ground. Plane 52 defines a relative position of the head 16 which causes the striking surface 26 to be perpendicular to the plane of top and bottom surfaces 44, 42. Plane 54 defines a relative position of the head 16 commonly referred to as "loft" whereby the striking surface 26 creates an angle 28 relatively negative with respect to plane 52. Plane 48 demonstrates the position of the head 16 creating a relatively positive angle 32 commonly known as "reverse loft," of the striking surface 26 with respect to plane 52.

FIG. 6 demonstrates an alternate embodiment providing for angulation of striking surface 26 without tilting head 16 relative to the ground as illustrated in FIG. 5. Plane 58 defines the relative position of striking surface 26 whereby plane 58 is perpendicular to top flat surface 44 and bottom flat surface 42. Plane 56 illustrates the position of the striking surface 26 commonly referred to as "loft" whereby angle 36 defines an angle relatively negative to plane 58. Conversely, plane 60 illustrates the position of the striking surface 26 commonly referred to as "reverse loft" whereby angle 34 defines an angle relatively positive to plane 58. The angulation of striking surface 26 illustrated in FIG. 6 may be achieved by grinding striking surface 26 to the desired angle, and the angulation of striking surface 26 illustrated in FIG. 5, however, is achieved through a change in the position of head 16.

To comport with the rules and regulations promulgated by the Professional Golf Association, the sum of angle 24 in FIG. 2 and angle 22 must be no less than ten degrees. Any combination of these respective angles may be used, for example, angle 24 may be in the range of 0–10 degrees and angle 22 may be in the range of 0–10 degrees, so long as the sum of the angles is not less than ten degrees.

The generally triangular shaped head 16 of golf putter 10 permits a golfer, in practice or non-PGA tournaments only, to assume at least three positions when putting. The golfer may putt assuming a traditional stance with the ball located in front of the golfer's body, and the swing of the club travels from one side of the golfer's body to the other side. Alternatively, the golfer may choose a putting position whereby the ball is located to one side of and slightly infront of the golfer, the swing of the club, then, travels from the golfer's back to front. Finally, the golfer may adjust the length of the shaft 13 to accommodate what is commonly referred to as a "hammer" put, whereby the golfer stands with one foot on either side of and slightly behind the ball, the backswing of the club passes alongside the golfer's legs, with a forward swing traveling in front of the golfer.

While the invention has been particularly shown and described in reference to preferred embodiments thereof, it will be understood by those skilled in the art that changes in form and details may be made therein without departing from the spirit and scope of the invention.

What is claimed is:

1. A golf club for use in putting, comprising:

a polycarbonate club head member having a generally triangular shape in plane and having a top surface, a bottom surface and a plurality of side surfaces, at least one of said side surfaces further comprising a striking surface for contacting a golf ball, said bottom surface further having a pair of angled surfaces, each of said angled surfaces having a downward slope from a bottom portion of one of said side surfaces toward a central portion of said bottom surface;

adjustable weighting means for varying the weight of said golf club, firmly affixed to said club head member;

aiming means for permitting a golfer to aim said golf club at a golf ball;

a shaft firmly engaged with said club head member for allowing a golfer to swing said club member; and means for permitting a golfer to grasp said shaft.

2. The golf club for use in putting according to claim 1, wherein said polycarbonate plastic further comprises a plurality of laminated polycarbonate plastic layers.

3. The golf club for use in putting according to claim 1, wherein said adjustable weighting means further comprises metal bands firmly affixed to said club head member.

4. The golf club for use in putting according to claim 1, wherein said adjustable weighting means further comprises a cavity in said club head, weights disposed in said cavity and a cap for enclosing said cavity.

5. The golf club for use in putting according to claim 1, wherein said aiming means further comprises a generally pyramidal shaped sight firmly affixed to a top surface of said club head member.

6. The golf club for use in putting according to claim 1, wherein said striking surface is generally perpendicular to said top surface.

7. A golf club for use in putting, comprising:

a generally triangular shaped head member having a top surface, a bottom surface having a pair of upwardly sloped surfaces, each of said upwardly sloped surfaces extending from a substantial midpoint of said bottom surface towards said top surface and terminating at an outer periphery of said head member and three sides, at least one of said sides further comprising a striking surface for contacting a golf ball;

metal weighting members firmly coupled to said generally triangular shaped head member for providing any desired weight to said head member;

a generally pyramidal centering sight firmly coupled to said top surface of said generally triangular shaped head member, said centering sight further comprising a light transmitting material;

a shaft member, having an adjustable length, firmly engaged to said generally triangular shaped club head member for permitting a golfer to swing said golf club; and a grip coupled to the upper end of said shaft member.

8. The golf club for use in putting according to claim 7, wherein said generally triangular shaped head member further comprises a polycarbonate plastic.

9. The golf club for use in putting according to claim 8, wherein said generally triangular shaped head member further comprises a plurality of laminated layers.

10. The golf club for use in putting according to claim 9 wherein said striking surface of said generally triangularly shaped head member is generally perpendicular to said top surface of said generally triangularly shaped head member.

* * * * *